US005778993A

United States Patent [19]

Moir

[11] Patent Number: 5,778,993

[45] Date of Patent: Jul. 14, 1998

[54] LOCKING A SAMPLE TUBE IN A DOWNHOLE HAMMER

[75] Inventor: Frederick Graham Moir, Canning Vale, Australia

[73] Assignee: SDS Pacific PTE, Ltd., Singapore, Singapore

[21] Appl. No.: 687,595

[22] PCT Filed: Aug. 1, 1995

[86] PCT No.: PCT/AU95/00466

§ 371 Date: Jul. 31, 1996

§ 102(e) Date: Jul. 31, 1996

[87] PCT Pub. No.: WO96/04459

PCT Pub. Date: Feb. 15, 1996

[30] Foreign Application Priority Data

Aug. 1, 1994 [AU] Australia ..... PM7201

[51] Int. Cl.[6] ..... E21B 4/14

[52] U.S. Cl. ..... 175/215; 175/296; 175/306

[58] Field of Search ..... 175/215, 244, 175/293, 296, 306, 405

[56] References Cited

U.S. PATENT DOCUMENTS

| | | | |
|---|---|---|---|
| 1,636,084 | 7/1927 | Thompson . | |
| 2,140,417 | 12/1938 | Conklin . | |
| 3,207,239 | 9/1965 | Hugel . | |
| 3,207,240 | 9/1965 | Hugel . | |
| 3,420,322 | 1/1969 | Mark . | |
| 4,296,822 | 10/1981 | Ormsby | 175/249 |
| 4,739,844 | 4/1988 | Farris et al. | 175/215 |
| 4,921,052 | 5/1990 | Rear | 175/215 |

FOREIGN PATENT DOCUMENTS 1100962 1/1968 United Kingdom .

*Primary Examiner*—Roger J. Schoeppel
*Attorney, Agent, or Firm*—Michael N. Meller

[57] ABSTRACT

A common problem with reverse circulation downhole hammers is retention of the sample tube that extends through the actual hammer component., There is a tendency for the sample tube to become loose in its mounting, and the resulting movement through vibration results in accelerated wear which rapidly leads to failure of the component In this application, the sample tube for use in a reverse circulation downhole hammer comprises a sample tube that has a lower end connected to a drill bit sample delivery aperture and an upper end connected to a drill string sample delivery tube. The sample tube has at least one projection intermediate the upper and lower ends of the sample tube that has a non-circular cross section extending radially from the sample tube. The projection locates within a recess that has a corresponding cross sectional shape, the recess being fixed with respect to the hammer to prevent rotation of the sample tube with respect to the hammer.

14 Claims, 4 Drawing Sheets

LOCKING A SAMPLE TUBE IN A DOWNHOLE HAMMER

Figure 1:
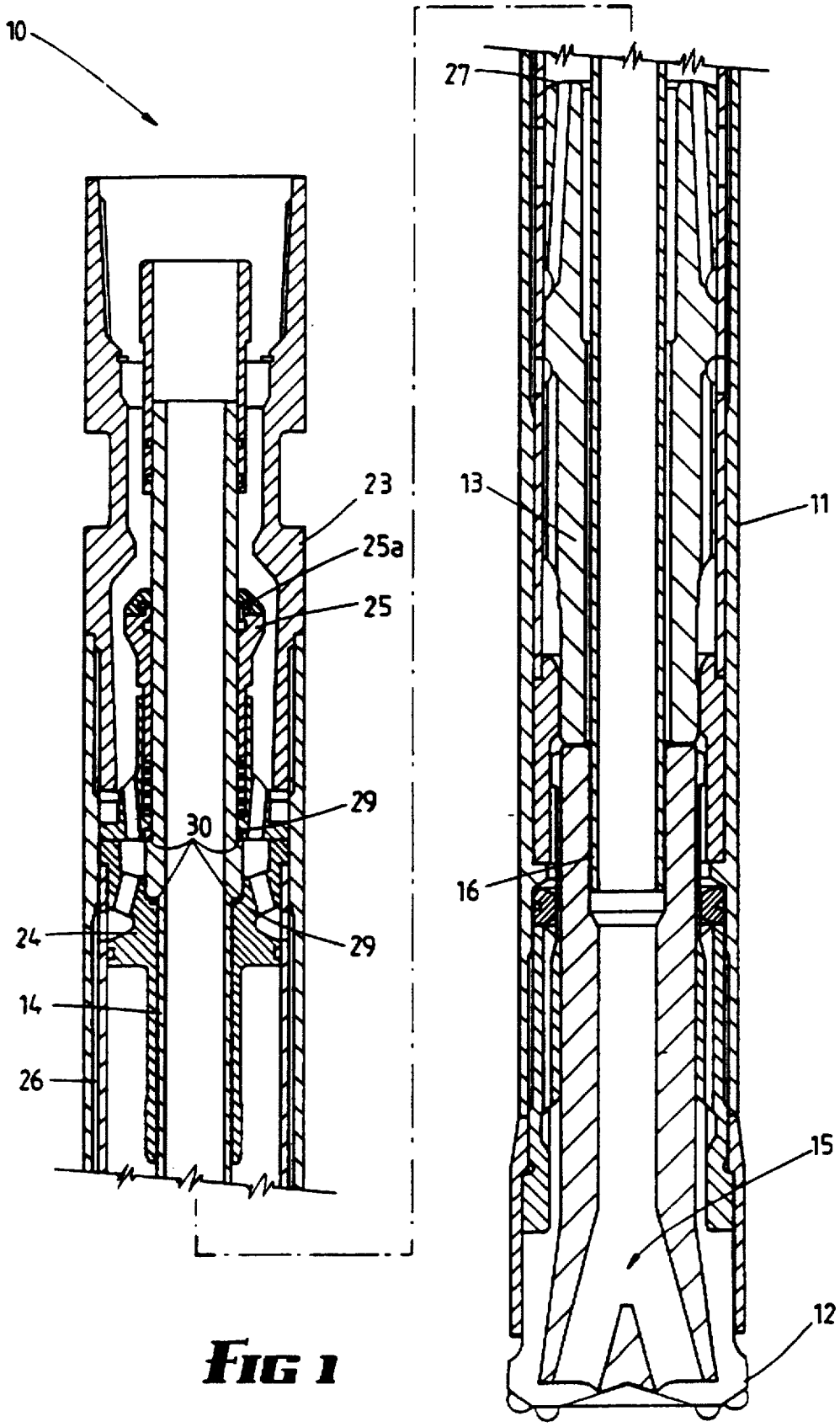

This invention relates to an improved sample tube for a downhole hammer, and in particular to a means for mounting a sample tube in a reverse circulation downhole hammer.

Reverse circulation downhole hammers normally comprise a downhole hammer housing which has a drill bit attached at one end. It has a drill string connection point via a top sub at the other. A compressed air powered piston reciprocates back and forth within a housing and impacts against the drill bit. A central sample tube extends through the hammer housing from a sample delivery aperture that extends through the drill bit, and is connected at its upper end to the inner tube of a reverse circulation drill pipe. The sample delivery tube extends through a central bore within the piston.

The sample tube is fixed with respect to the downhole hammer housing, and therefore both the piston and the drill bit move with respect to this stationary tube. The lower end of the sample delivery tube is located within a central bore in the upper end of the drill bit. A bore or channel extends through the drill bit to allow drill chips from the cutting face to enter the sample tube. There is a sliding fit between the end of the sample tube and the drill bit to prevent blow-back from the lower piston chamber and to ensure that drilling debris does not enter the lower piston chamber.

The bore through the center of the piston is sufficiently large to provide a clearance with respect to the sample tube. Although there is no contact by the piston, the impact forces transmitted from the drill bit result in significant longitudinal and torsional loads being applied to the sample tube.

The sample tube is provided with a radial flange or projection intermediate its upper and lower ends. This flange or projection locates within recesses in an assembly which is fixed with respect to the downhole hammer housing. In most cases, the assembly comprises a compressed air distributor and a check valve guide. The two components abut against one another, and are held with respect to the downhole hammer housing by the top sub which screws into the end of the hammer body.

The compressed air distributor is provided with a recess or counterbore portion within which the radial flange locates. The upper surface of the flange is flush with the upper level of the compressed air distributor and when the valve guide body locates against this surface, the sample tube is held in place.

The radial flange and respective recess within the compressed air distributor are designed to secure the sample tube with respect to the downhole hammer housing. However, because of the forces transmitted along the sample tube as a result of the drill bit, wear can occur which allows the sample tube to rotate within its mounting assembly. The rotation itself causes further rapid wear, and as a result, compressed air can leak from the center of the compressed air distributed along the outside surface of the sample tube into the upper piston chamber. This will prevent the hammer from operating at full power, or at worst prevent its operation altogether.

Although the downhole hammer is a complex piece of equipment, its design nonetheless needs to be as simple as possible to ensure easy maintenance and assembly, while at the same time providing a robust design that can withstand the severe operating conditions.

Therefore, it is an aim of this invention to provide a means of preventing excessive wear of various components normally caused by rotation of the sample tube, and to provide a design which is simple yet effective.

In its broadest form, the invention is a sample tube for a reverse circulation downhole hammer comprising a sample tube for a reverse circulation downhole percussive hammer, wherein said percussive hammer comprises a hammer body having an upper and lower end, a percussive drill bit connected to said hammer body at said lower end, a piston that reciprocates within said hammer body and strikes said drill bit at one end thereof and a sample tube extending from said drill bit, through said piston towards the upper end of said hammer body, said sample tube comprising:

an elongated substantially tubular member for engaging said drill bit to enable sample to be transferred from said drill bit to said sample tube, with said sample tube engaging a drill-string sample delivery tube, at least one projection located substantially intermediate the opposite ends of said sample tube and having a non-circular cross-section normal to the longitudinal axis of said sample tube, and a mounting collar within said hammer body with walls defining a recess within which said one projection locates, said walls engaging said one projection with said mounting collar being fixed within said hammer body so that said sample tube is prevented from rotating with respect to said hammer body.

The projection on the sample tube has an irregular cross-section to prevent rotation of the sample tube with respect to the recess or other mounting means. Preferably, the projection has an elliptical cross-section, but other cross-sectional shapes may be used. For example, a circular cross-section in combination with at least one flat edge such as part round, square or rectangular shapes, or bar-like elements, will also work quite satisfactorily.

The mounting collar is preferably the assembly of the compressed air distributor and valve seat, with the recess formed between the distributor and the valve seat. However, a mounting collar or other suitable mounting arrangements may be used without departing from the spirit of the invention. A recess corresponding to the cross-sectional shape of the projection may be formed only in one half of the distributor valve seat assembly, i.e. the compressed air distributor only. The recess may also be part formed in both of the assembly components.

By part forming recesses in both the valve seat and the compressed air distributor, and by having a projection engage the two recesses, then the valve seat and compressed air distributor are locked with respect to one another. This prevents relative rotation, and allows alignment of air delivery passages. In the past, this has not been possible, and an intermediate chamber or manifold was required between the valve seat and compressed air distributor because of relative rotation. Alignment of the air delivery passages will allow smoother air flow which dramatically improves the efficiency of hammer operation.

Air delivery passages may be grouped either side of the major axis of the recess in the air distributor, rather than evenly distributing them around the recess. This provides sufficient space for location of the recess in the face of the distributor, particularly in the case of an elliptical recess.

The sample tube may be a one piece component, or it may be constructed from two or more components to produce the required length. In such an arrangement, a male and female connecting end may be provided, and two projections may be provided with one being located on each end of the connecting elements.

In order for the invention to be fully understood, a preferred embodiment will now be described, but it should be realised that the scope of the invention is not to be confined or restricted to the precise details of this embodiment.

The embodiment is illustrated in the accompanying representations in which:

FIG. 1 shows a cross-sectional view of a reverse circulation downhole hammer.

Figure 2:
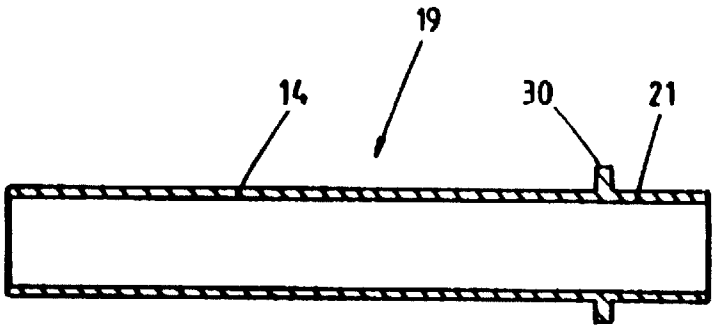
Figure 2A:
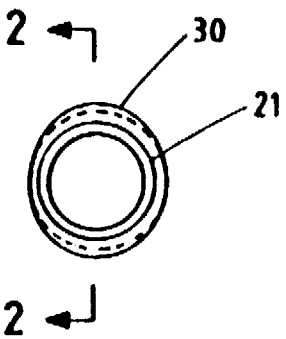

FIGS. 2 and 2*a* show a cross-sectional view and end view respectively of an upper end of a sample tube.

Figure 3:
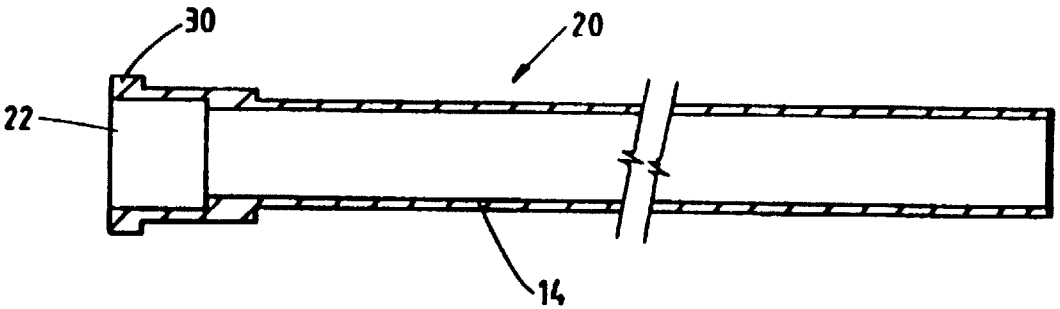
Figure 3A:
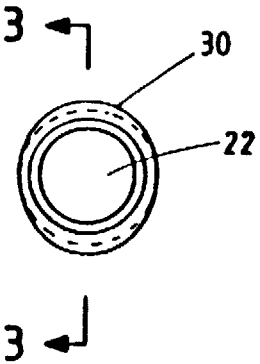

FIGS. 3 and 3*a* show a cross-sectional view and end view respectively of a lower end of a sample tube.

Figure 4:
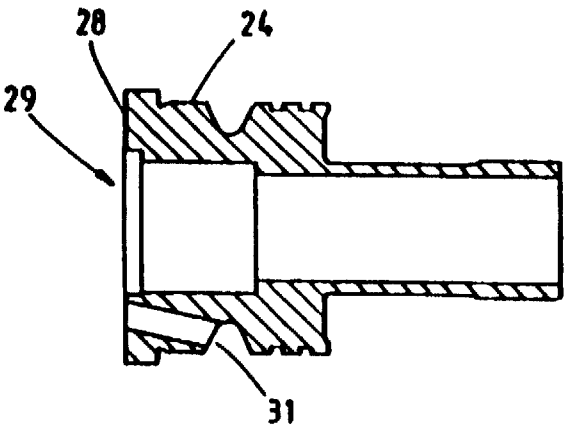
Figure 4A:
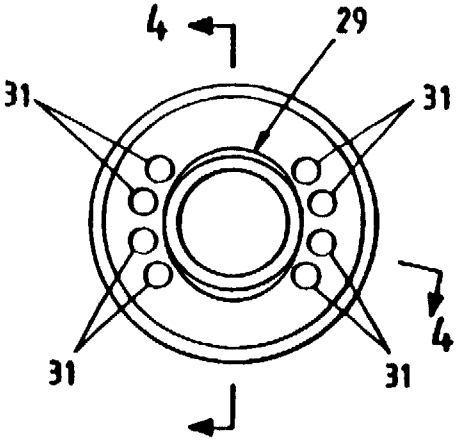

FIGS. 4 and 4*a* show a side cross-sectional view and an end view respectively of an air distributor.

Figure 5A:
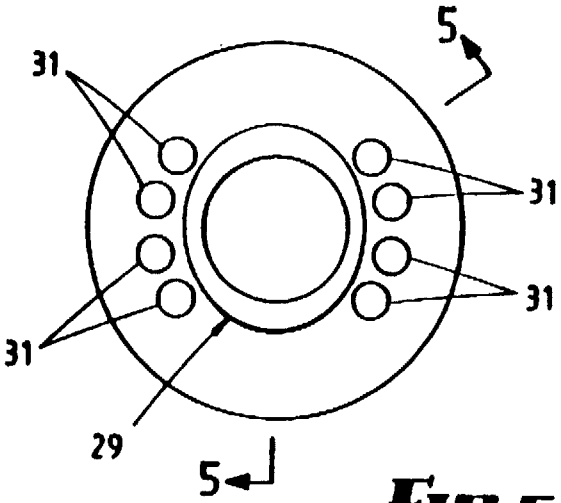
Figure 5:
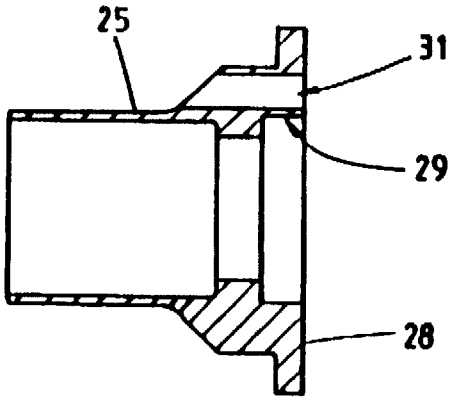
Figure 6:
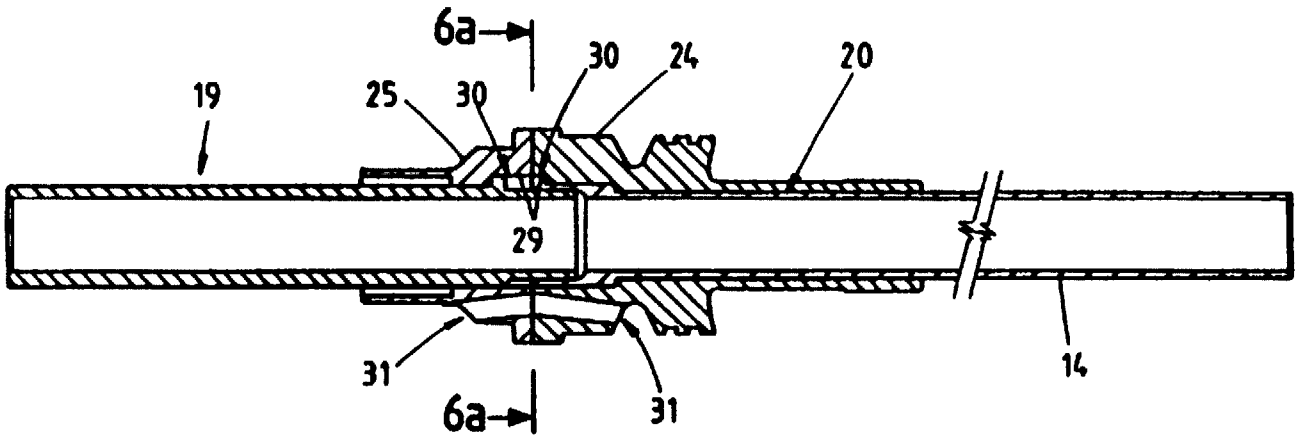
Figure 6A:
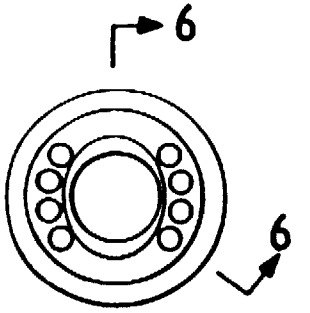

FIGS. 5 and 5*a* show a side cross-sectional view and end view respectively of a valve guide, and FIGS. 6 and 6*a* show a side cross-sectional view and end cross-sectional view respectively of an assembled sample delivery tube, air distributor and valve guide.

FIG. 1 shows a cross-sectional view of a reverse circulation downhole hammer assembly 10. The basic elements comprise a hammer body 11, a drill bit 12, a piston 13 and a sample delivery tube 14.

The drill bit 12 has a sample delivery passage 15 that transfers drilling chips from the cutting surface into the sample tube 14. The lower end 16 of the sample tube locates within the sample delivery passage 15 of the drill bit 12 in an aperture that is sized to provide a sliding fit between the drill bit 12 and the sample tube 14. The drill bit 12 reciprocates along the longitudinal axis of the downhole hammer 10 and moves with respect to the delivery tube 14. The sliding fit between the lower end 16 of the sample tube 14 and the drill bit 12 prevents cuttings blowing into the piston chamber.

In this embodiment, the sample tube 14 comprises an assembly of an upper and lower portion 19 and 20. The upper portion 19 is shown in FIG. 2, and the lower portion 20 is shown in FIG. 3. The upper portion 19 is provided with a male coupling 21, and the lower portion 20 is provided with a female coupling 22.

The sample tube 14 is held within the hammer body 11 by a mounting collar which, in this embodiment, comprises a compressed air distributor 24 and a valve guide 25. The primary function of the valve guide is to support the check valve 25*a* which seals the airflow passage while the downhole hammer 10 is not operating. The distributor 24 directs compressed air to the delivery channels 26 around the piston sleeve 27. Both the distributor 24 and valve guide 25 are mounted within the downhole hammer 10 so that they are secured with respect to the hammer body 11. They are held in place by the top sub 23 which is screwed into the end of the hammer body 11. As seen in FIG. 1, the distributor 24 and valve guide 25 each have mating surfaces 28 that abut against one another and the sample tube 14 extends through the centre of both the distributor 24 and valve guide 25.

Both the distributor 24 and valve guide 25 are provided with recesses 29 and the sample tube 14 is provided with two projections 30 which locate within the recesses 29. As seen in FIGS. 2 and 3, the projections 30 comprise elliptical shaped flanges that extend radially from the surface of the sample tube 14. The recess 29 has a corresponding elliptical shape, and therefore the sample tube 14 is locked in place and prevented from rotation. As shown in FIG. 6 the projection 30 on the upper portion 19 locates fully within the recess 29 of the valve seat 25. The projection 30 on the lower portion 20 locates within the recess 29 of both the valve seat 25 and the compressed air distributor 24 which in turn prevents relative rotation between the valve seat 25 and the compressed air distributor 24. This enables alignment of the air delivery passages 31 in the valve seat 25 and compressed air distributor 24 as shown in FIG. 6.

The recess 29 in the distributor 24 is shown in FIG. 4. The air delivery passages 31 are grouped either side of the major axis of the elliptical recess 29. This provides sufficient space for the ellipse in the distributor 24.

The male and female couplings 22 and 21 are held together between the distributor 24 and valve guide 25 which themselves are forced together when the downhole hammer 10 is assembled.

Despite the high percussive loading which is transferred to the sample delivery tube 14 via the piston 13 and drill bit 12, the use of non-circular shaped projections such as elliptically shaped projections 29 locks the sample tube 14 and prevents it from rotating. This dramatically increases the life of the sample tube 14, which in turn prevents premature malfunction of the downhole hammer 10.

The claims defining the invention are as follows:

1. A sample tube for a reverse circulation downhole percussive hammer, wherein said percussive hammer comprises a hammer body having an upper and lower end, a percussive drill bit connected to said hammer body at said lower end, a piston reciprocates within said hammer body and strikes said drill bit at one end thereof and a sample tube extending from said drill bit, through said piston towards the upper end of said hammer body, said sample tube comprising:

an elongated substantially tubular member for engaging said drill bit to enable sample to be transferred from said drill bit to said sample tube, with said sample tube engaging a drill-string sample delivery tube, at least one projection located substantially intermediate the opposite ends of said sample tube and having a non-circular cross-section normal to the longitudinal axis of said sample tube, and a mounting collar within said hammer body with walls defining a recess within which said one projection locates, said walls engaging said one projection with said mounting collar being fixed within said hammer body so that said sample tube is prevented from rotating with respect to said hammer body.

2. A sample tube in accordance with claim 1, wherein the cross-sectional shape of said at least one projection is elliptical.

3. A sample tube according to claim 1, wherein the cross-sectional shape of said at least one projection is generally circular with at least one flat edge.

4. A sample tube according to claim 1, wherein the cross-sectional shape of said at least one projection is rectilinear.

5. A sample tube according to claim 1, wherein said at least one projection comprises at least one pin extending radially from said sample tube.

6. A sample tube according to claim 1, wherein said sample tube comprises an upper and lower portion that, when coupled together, form said sample tube.

7. A sample tube according to claim 6, wherein said at least one projection is adjacent the coupling between said upper and lower sample tube portions.

8. A sample tube according to claim 7, wherein said lower portion has a female connection and said upper portion has a male connection.

9. A sample tube according to claim 7, wherein said at least one projection comprises two projection portions, one on said lower sample tube portion, and one on said upper sample tube portion.

10. A sample tube according to claim 9, wherein said two projection portions abut to form a single projection portion.

11. A sample tube according to claim 1, wherein said mounting collar comprises a compressed air distributor through which said sample tube passes, said distributor having said recess formed therein.

12. A sample tube according to claim 11, wherein said mounting collar further comprises a valve seat that is attached to said distributor, said valve seat and said distributor each having a mating surface that abut for attachment to one another, said sample tube also passing through said valve seat.

13. A sample tube according to claim 12, wherein said recess is part formed in both said valve seat and distributor.

14. A sample tube according to claim 13, wherein said projection is clamped between said valve seat and distributor.

* * * * *